United States Patent [19]

Shatto, Jr.

[11] 4,132,252

[45] Jan. 2, 1979

[54] METHOD AND APPARATUS FOR DEPLOYING WIRES

[75] Inventor: Walter C. Shatto, Jr., Harrisburg, Pa.

[73] Assignee: AMP Incorporated, Harrisburg, Pa.

[21] Appl. No.: 853,992

[22] Filed: Nov. 21, 1977

[51] Int. Cl.[2] ..... B21F 1/02

[52] U.S. Cl. ..... 140/147

[58] Field of Search ..... 140/147; 29/461, 749, 29/755

[56] References Cited

U.S. PATENT DOCUMENTS

| | | | |
|---|---|---|---|
| 3,083,743 | 4/1963 | Fick | 140/147 |
| 3,936,933 | 2/1976 | Folk et al. | 140/147 |

*Primary Examiner*—Lowell A. Larson

*Attorney, Agent, or Firm*—Anthony S. Volpe

[57] ABSTRACT

Templet and roller means for deploying a plurality of wires comprising a templet block having a working surface extending thereacross to one end and a triangular deploying surface and staging surface recessed within the working surface at a position intermediate of the surface. A plurality of grooves and ridges diverge from the deploying surface and extend to the one end, each groove being dimensioned to receive one wire. Upon positioning the wires upon the staging surface with the axis extending toward the other end, and upon movement of the roller over the working surface towards the other end, the wires are successively diverted into the grooves and positioned in side-by-side spaced-apart relationship.

9 Claims, 9 Drawing Figures

12
30
22
28
26
28-1'
26-1'
28-1
26-1
Wd
32
20
18
34
20
14
8
Ws
6
24
24
16
10

METHOD AND APPARATUS FOR DEPLOYING WIRES

FIELD OF THE INVENTION

The instant invention relates generally to a method and apparatus for deploying and locating a plurality of wires in side-by-side spaced-apart co-planar relationship. The apparatus can deploy wires which are initially in co-planar array as in ribbon cable or the like, and wires which are randomly oriented in a bundle as in a cable of the type commonly used in the communications industry. One example of cables used in the telephone industry is a cable comprising 25 insulated wire pairs in an outer insulating sheath. A preferred embodiment of the instant invention comprises a templet and roller means which can be motivated by suitable means such as a press ram of the type claimed and described in U.S. Pat. No. 4,043,017 which is hereby incorporated by reference.

BACKGROUND OF THE INVENTION

Heretofore, performing any specific work or testing operation on a large number of wires necessarily involved numerous and intensive manual manipulations of the wires. In order to automatize the manipulation of a large plurality of wire leads which are either initially in co-planar array or a disoriented bundle, it was necessary to achieve an apparatus for precisely locating and deploying these leads in spaced-apart side-by-side co-planar relationship. U.S. Pat. No. 3,891,013 teaches and describes method and apparatus suitable for deploying a number of wires which are initially co-planar and the principles of this invention have been used under a variety of specific conditions. Difficulties are sometimes encountered when it is attempted to deploy wires which are initially in a disordered bundle as in a cable and the templet as disclosed is not structured to safeguard against damage to the leads during the rolling process. The preferred embodiment of the instant invention can deploy a large plurality of wires in side-by-side co-planar relationship when such wires are initially in a bundle, and the templet of the instant invention is structured so as to minimize the risk of damage to the leads in the rolling process.

This invention is therefore illustrated through a preferred embodiment which comprises a roller means and templet having working, splaying, staging, and deploying surfaces with ridges and grooves extending from the deploying surface.

Accordingly, it is an object of the instant invention to provide an apparatus which will deploy and position a large plurality of wire leads in side-by-side spaced-apart co-planar relationship. A further object of the instant invention is to provide an apparatus which will deploy wires in side-by-side co-planar relationship when such wires are initially in a disordered bundle. Orienting the wires is a necessary prelude to further manipulation of the wires.

These and other objects of the invention are achieved through a preferred embodiment which is briefly described above and described in more detail below and which is illustrated in the accompanying drawings in which:

FIG. 3 is a top plan view of the templet.

Figure 1:
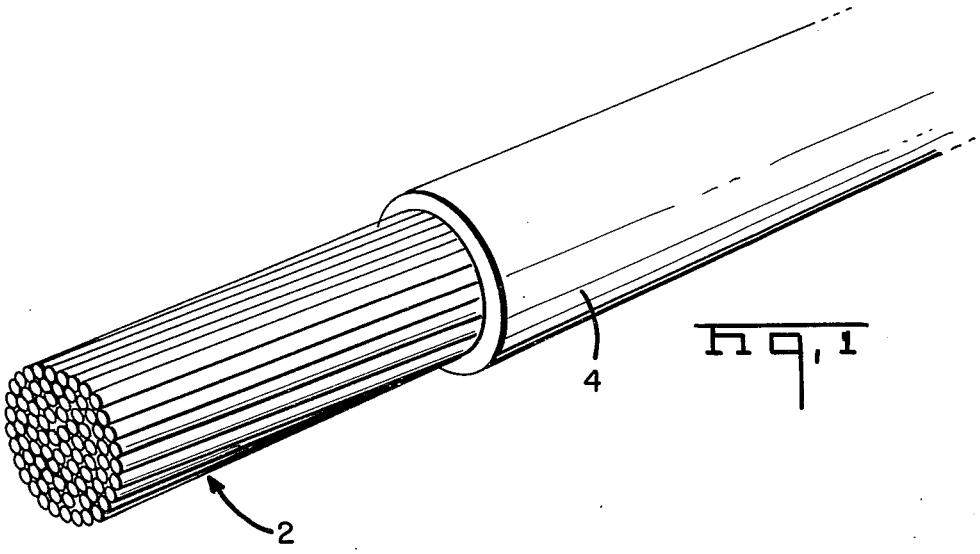
FIG. 1 is a perspective view of wires in a cable.
Figure 2:
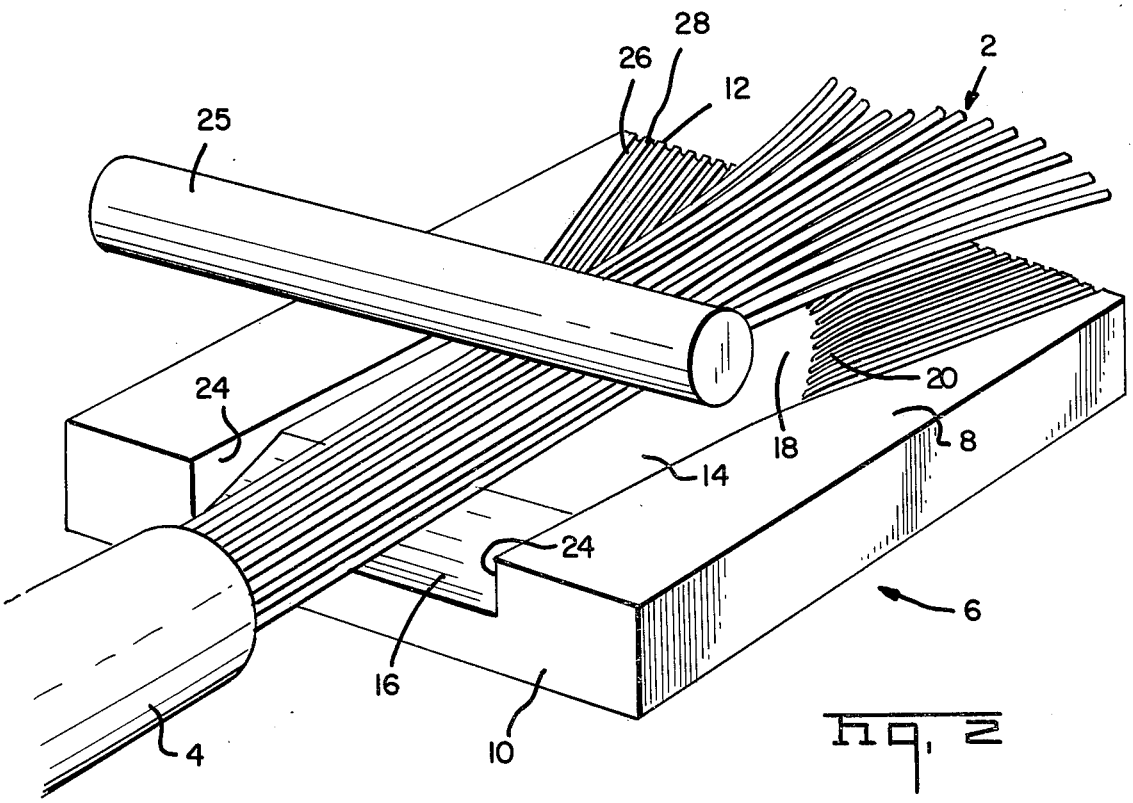
FIG. 2 is an exploded perspective view of the templet block, roller means, and wires in a cable.

Referring first to FIGS. 1 and 2, wires 2 of a cable are contained within an insulating sheath 4. Templet block 6 has a working surface 8 extending thereacross from one end 10 to another end 12. Staging surface 14 is disposed within and parallel to the working surface 8 and extends between side edges 24. Staging surface 14 is recessed below working surface 8 by a distance which is substantially equal to the diameter of one of the wires 2. Splaying surface 16 extends from staging surface 14 between side edges 24 to one end 10, and is of increasing displacement from working surface 8 toward one end 10.

Referring now to FIGS. 2 and 3, a deploying surface 18 extends from staging surface 14 toward other end 12. Deploying surface 18 is substantially triangular and has marginal side portions 20 and an apex portion 22 which is proximate to other end 12. Diverging from marginal side portions 20 of deploying surface 18 and extending toward other end 12 are grooves 26 which are defined by ridges 28. While the preferred embodiment of the instant invention as illustrated in FIG. 3 shows symmetrical diversion of grooves 26 and ridges 28, it can be appreciated that an alternative embodiment of the instant invention might comprise a templet having diverging grooves and ridges from only one side portion of the deploying surface. Further, the preferred embodiment described and disclosed above is an ideal manifestation of the principles of the instant invention intended to give ideal results. In certain situations, such as when a small number of wires are to be deployed or when the wires are coarse or extremely rigid, acceptable results may be obtainable by simplified or less than ideal approximations of the preferred embodiment of the instant invention. The scope of the instant invention is intended to include all such alternative approximations which rely upon the teachings herein set forth.

Figure 4:
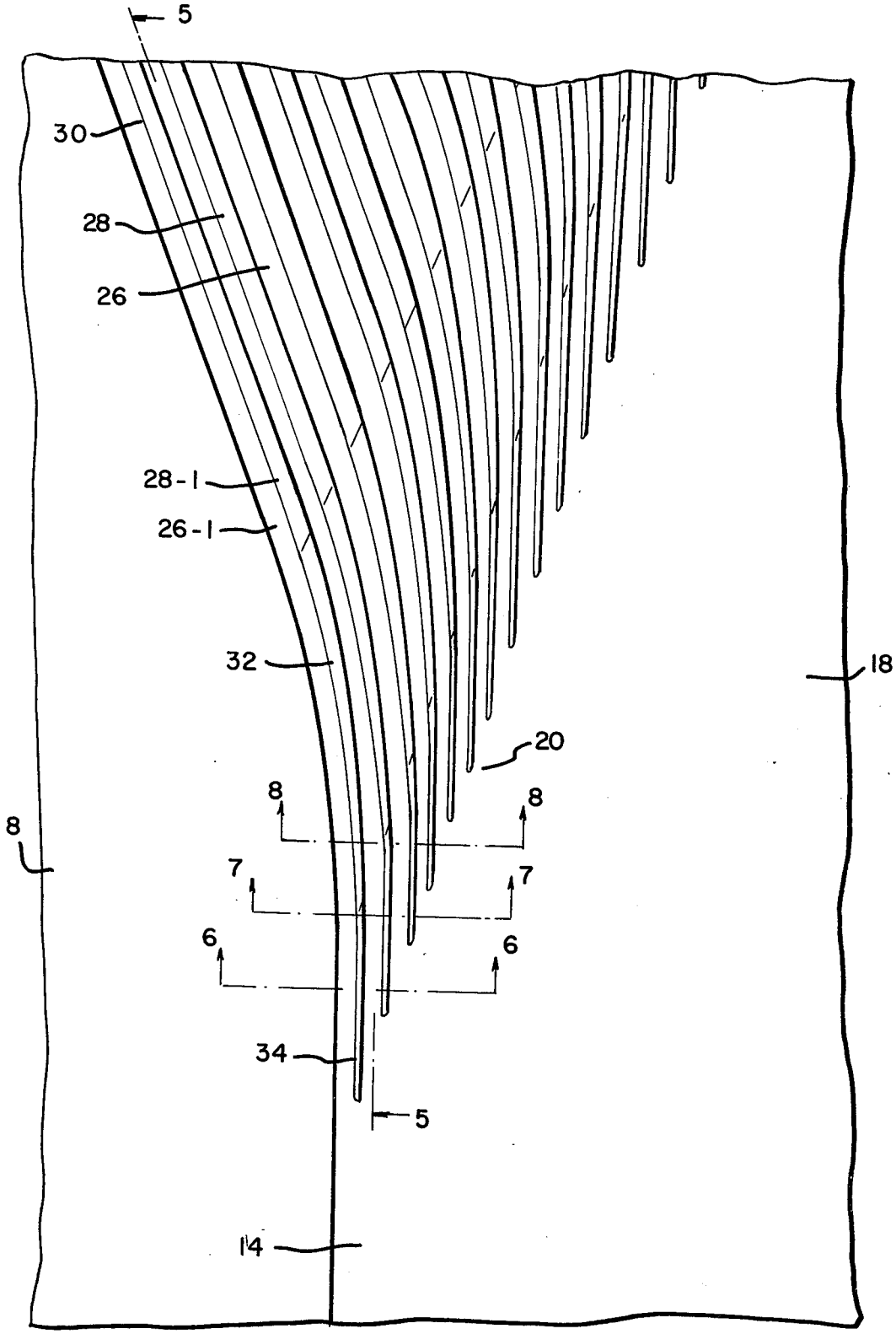
FIG. 4 is a fragmentary top plan view of the templet.
Figure 5:
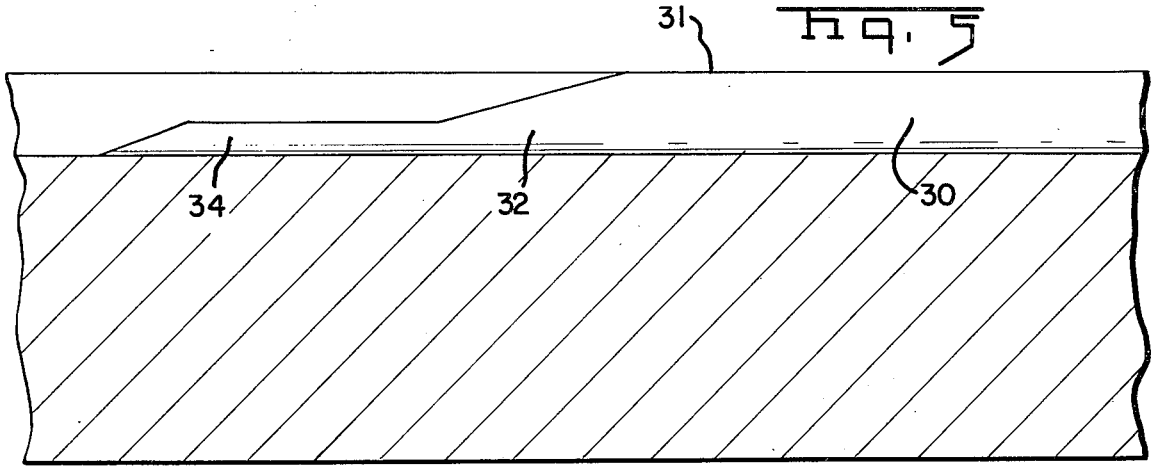
FIG. 5 is a view taken along lines 5—5 of FIG. 4.

Referring now to FIGS. 3, 4, and 5. Grooves 26 are dimensioned to receive one of the wires 2. Each of the ridges 28 has its origin at the marginal side portions 20 of deploying surface 18, and has a first portion 30, a second portion 32, and a third portion 34. The first portion 30 of each of the ridges 28, has an upper surface 31 which is co-planar with surface 8 and which is of uniform width. Second portion 32 of each of the ridges 28 has an upper surface 31 which extends toward the plane of the deploying surface 18 and away from the plane of the working surface 8. Specifically, FIG. 4 illustrates the second portion 32 of each of the ridges 28 to be of diminishing width towards the marginal side portion 20 of deploying surface 18. Third portion 34 of each of the ridges 28 has an upper surface 31 constituting an edge which extends parallel to side edges 24 and towards marginal side portions 20. Third portion 34 of each of the ridges 28 has an altitude with respect to deploying surface 18 substantially equal to one half the diameter of one of the wires 2, and serves to establish initial control over each of the wires 2 which are to be diverted from deploying surface 18. The third portion 34 of ridges 28 then decreases in altitude to merge with marginal side portions 20. In other words, ridges 28 have upper surfaces 31 which are co-planar with working surface 8 proximate to other end 12. Second portions 32 of ridges 28 are tapered in altitude and width until their upper surfaces constitute edges having an altitude above deploying surface 18 substantially equal to one half the diameter of one of the wires 2. These edges then extend parallel to side edges 24 until finally tapering toward and merging with marginal side portions 20 of deploying surface 18. FIG. 4 specifically illustrates the decrease in width each of the ridges 28 undergoes toward one end 10, and FIG. 5 specifically illustrates the altitudinal tapering of second portion 32 of ridges 28. It is the generation of the third portion 34 of ridges 28 which establishes initial control over the wires to be diverted from deploying surface 18.

Figure 7:
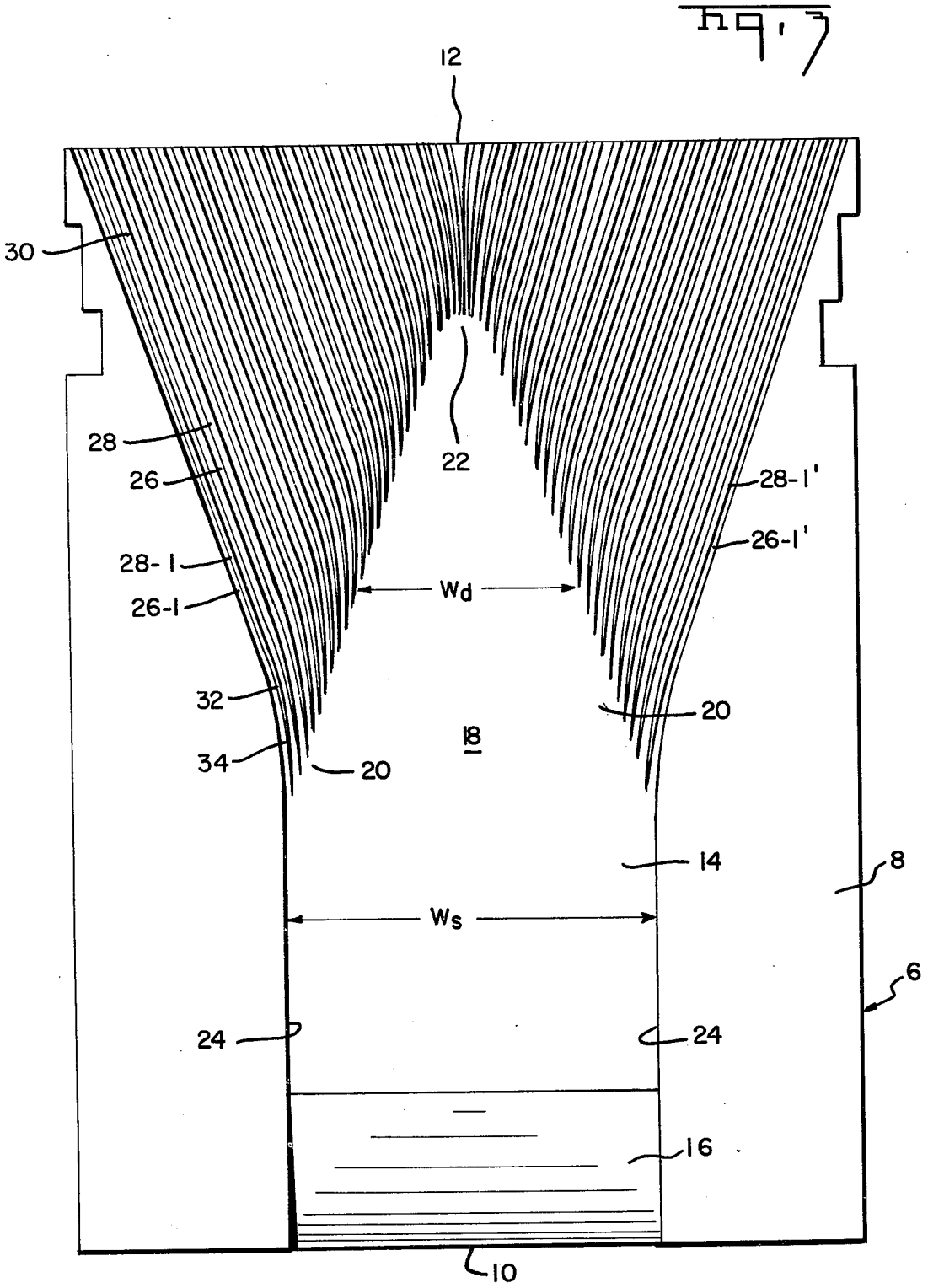
FIG. 7 is a view taken substantially along lines 7—7 of FIG. 4.
Figure 6:
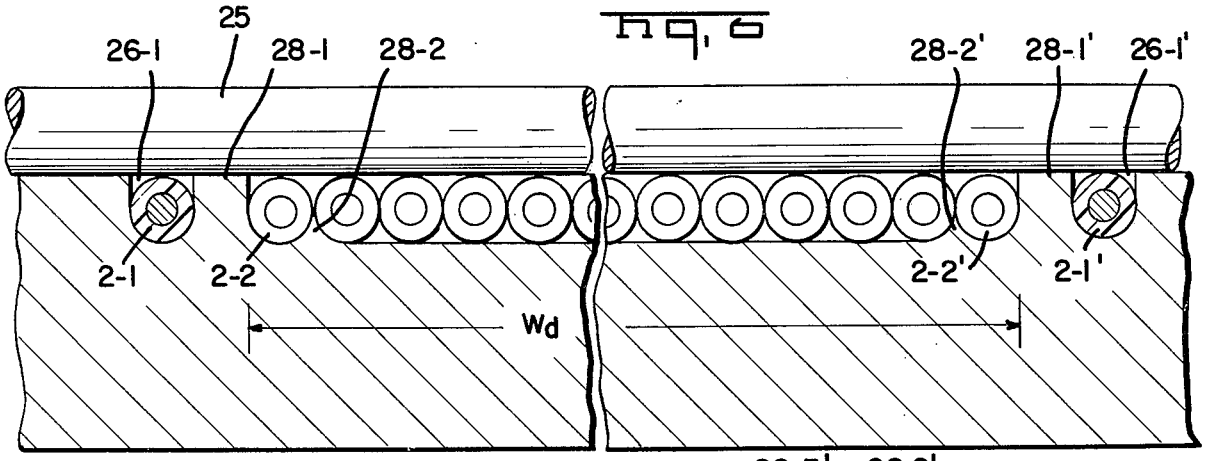
FIG. 6 is a view taken substantially along lines 6—6 of FIG. 4.
Figure 7:
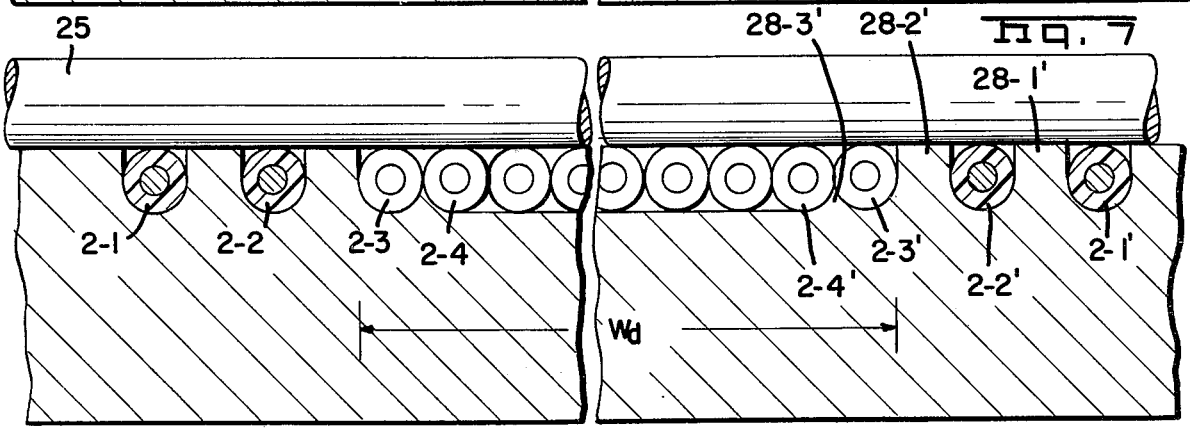
Figure 8:
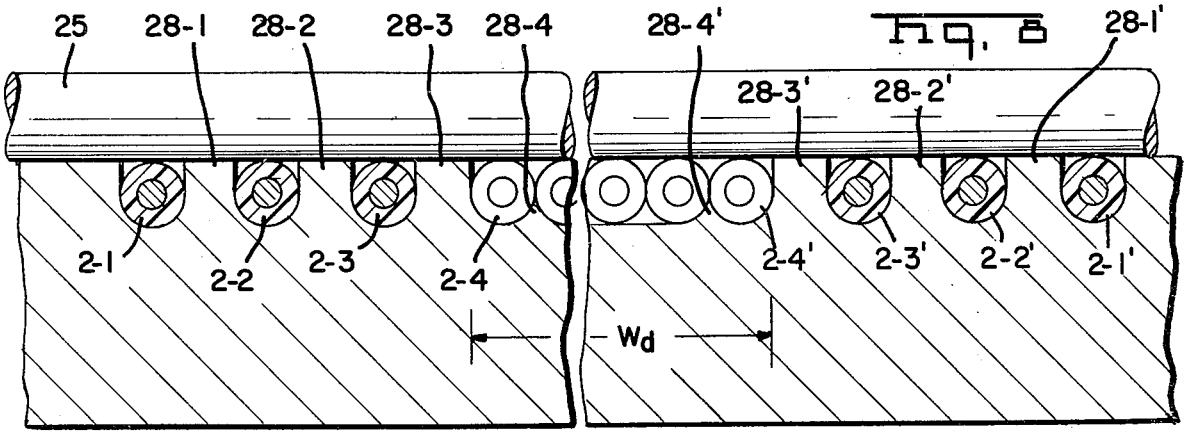
FIG. 8 is a view taken substantially along lines 8—8 of FIG. 4.
Figure 9:
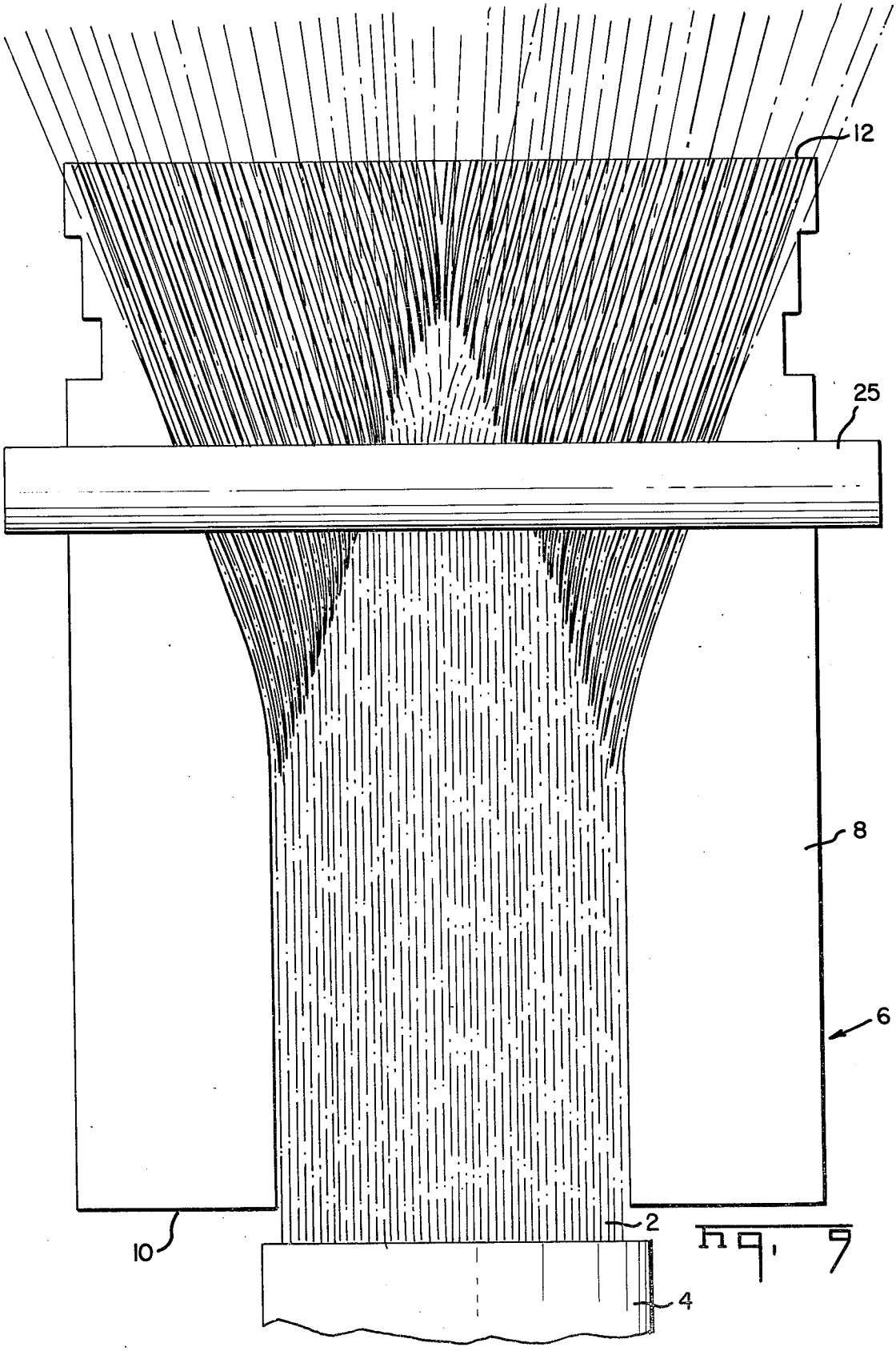
FIG. 9 is a top plan view similar to FIG. 3 but showing the wires and roller means.

FIGS. 6, 7, and 8 show three stages in the rolling cycle. Referring first to FIG. 6, outermost wires 2-1 and 2-1′ are directed from deploying surface 18 into grooves 26-1 and 26-1′ by the generation of ridges 28-1 and 28-1′ respectively. It is apparent that as grooves 26-1 and 26-1′ are fully formed by ridges 28-1 and 28-1′, the third portions 34 of ridges 28-2 and 28-2′ are being generated to establish initial control over wires 2-2 and 2-2′ respectively. FIG. 7 illustrates the apparatus when the four outermost wires have been diverted from deploying surface 18 and initial control established over wires 2-3 and 2-3′ by the generation of the third portions 34 of ridges 28-3 and 28-3′. FIG. 8 shows the apparatus at a subsequent stage of the rolling cycle after six wires have been diverted from the deploying surface 18 and initial control obtained over wires 2-4 and 2-4′ by the generation of third portions 34 of ridges 28-4 and 28-4′.

Referring now to FIGS. 3, 6, 7, 8 and 9. Width $W_s$ of staging surface 14 can be mathematically defined as equalling $n \times D$, where n is the number of wires 2 in a bundle, and D is the diameter of one of the wires 2. A bundle of wires 2 having an outer sheath 4 is placed on splaying surface 16 with the axes of the wires 2 extending over the staging surface 14 and deploying surface 18 towards the other end 12 of templet 6. A rolling means 26 is lowered to working surface 8 and thereacross toward the other end 12 by suitable means such as a press ram and of the type disclosed and claimed in U.S. Pat. No. 4,043,017 incorporated above by reference. When the pressing means 26 is lowered to working surface 8, wires 2 are confined in a cross sectional area defined by the splaying surface 16, side edges 24, and the lower surface of rolling means 26. As the pressing means 26 is moved across the working surface 8 towards other end 12, the cross sectional area in which wires 2 are confined becomes progressively smaller as the displacement between splaying surface 16 and the working surface 8 decreases, and wires 2 are forced to laterally realign themselves within the smaller area. The smooth splaying surface 16 and deploying surface 18 facilitates such a lateral realignment of wires 2. When roller means 26 reaches a position above staging surface 14, wires 2 are in a side-by-side touching relationship and side edges 24 are exerting a transverse compressive force on the array of wires 2. It can be appreciated that the outermost pair of wires 2-1 and 2-1′ are necessarily and precisely locatable against the side edges 24 when roller means 26 is at a position above staging surface 16. The innermost wires in the array are not locatable with such a high degree of precision because of the compliance of the wires 2 and the compressive forces exerted upon the innermost wires in the array. For this reason, initial control is first established over the locatable outermost wires 2-1 and 2-1′ by generation of ridges 28-1 and 28-1′ and then, as full control is achieved, the outermost wires 2-1 and 2-1′ act as a reference by which the next outermost wires 2-2 and 2-2′ can be located and then controlled. Roller means 26 proceeds across working surface 8 to a position above deploying surface 18 where ridges 28-1 and 28-1′ are generated from marginal side portions 20. Third portion 34 of ridges 28-1 and 28-1′ establish initial control over wires 2-1 and 2-1′ which then rest in partially formed grooves 26-1 and 26-1′. Then as the second portion 32 of ridges 28-1 and 28-1′ diverge from the deploying surface 18 and direct outermost wires 2-1 and 2-1′ away from the array of wires 2, ridges 28-2 and 28-2′ are generated between wires 2-2 and 2-3 and 2-2′ and 2-3′. Width $W_d$ represents the width at any point of deploying surface 18 towards other end 12, and is mathematically described as equal to $nD - xD$ where n is the number of wires in a bundle of wires 2, D is the diameter of one of wires 2 and x is the number of wires diverted prior to that point. As roller means 26 proceeds toward end 12, second portion 32 of ridges 28 divert from wires 2-2 and 2-2′ from the array of wires 2 and then subsequently diverts outermost wires successively until all of the wires 2 are diverted into grooves 26 as defined by ridges 28. Wires 2 are thereby positioned in side-by-side co-planar relationship and being so fixed can then be subjected to further work or testing operations. It will be appreciated that while the preferred embodiment of the instant invention teaches symmetrical divergence of outermost wires of an array of wires 2, deployment of only part of the wires 2 in an array can be accomplished through alternative embodiments of the instant invention which will be apparent to one skilled in the art.

The embodiment of the invention disclosed herein can be used under circumstances where it is desired simply to separate and deploy the wires in a bundle or cable and locate them in side-by-side spaced-apart relationship to facilitate operations which might be performed on the wires. For example, a simple templet of the type shown in the drawing can be used to deploy the wires in a cable and the deployed wires can then be carried to an apparatus for connecting the wire ends to terminals. The principles of the invention can, of course, also be used in a variety of wire handling apparatus such as cable making machines as shown, for example, in U.S. Pat. No. 4,043,017.

I claim:

1. Templet and roller means for deploying a plurality of wires and locating said wires in side-by-side spaced-apart relationship, said templet and roller means comprising:

a templet block having a working surface, said roller being movable over said working surface from one end of said block to the other end thereof, a recessed staging surface within said working surface, said staging surface being parallel to said working surface and being recessed beneath said working surface by a distance which is substantially equal to the diameter of one of said wires, said staging surface having a width which is substantially equal to the combined diameters of all of said wires whereby said wires can be staged in side-by-side co-planar relationship on said staging surface with adjacent wires against each other and with the axes of said wires extending towards said other end of said block, a deploying surface which is co-planar with said staging surface, said deploying surface extending towards said other end of said block and being of decreasing width in the direction extending towards said other end, a plurality of wire deploying grooves, each of said grooves having an origin at said deploying surface and extending from said deploying surface through said working surface and towards said other end of said block, each of said grooves being dimensioned to receive one of said wires, the one of said grooves which receives an outside wire in a group of wires on said staging surface having its origin located at a maximum distance from said other end, and successive grooves having their origins located at progressively decreasing distances from said other end whereby, upon positioning said wires in side-by-side parallel relationship on said staging surface with said wires extending towards said other end of said templet block, and upon movement of said roller over said working surface towards said other end of said block, said wires will be successively diverted into said grooves from said deploying surface and portions of said wires at said other end of said block will then be located in side-by-side spaced-apart relationship.

2. Templet and roller means as set forth in claim 1, said deploying surface being generally triangular and having its apex proximate to said other end of said block, said deploying surface having marginal side portions which extend from said apex divergently to said staging surface, said grooves merging with said deploying surface at said side portions.

3. Templet and roller means as set forth in claim 1, said wire-receiving grooves being separated by ribs, first portions of said ribs having top surfaces which are part of, and co-planar with, said working surface, other portions of said ribs which are proximate to said deploying surface being tapered in altitude and width towards said deploying surface, and portions of said ribs which are immediately adjacent to said deploying surface having top edges which slope towards, and merge with, said deploying surface thereby to facilitate diversion of said wires into said grooves during movement of said roller over said working surface and past said deploying surface.

4. Templet and roller means as set forth in claim 1 having a splaying surface extending from said staging surface to said one end of said templet block said splaying surface extending away from said working surface and being of increasing depth as it extends away from said staging surface whereby, a bundle of said wires can be positioned on said splaying surface and upon movement of said roller over said working surface, said wires will be splayed and located in side-by-side parallel relationship on said staging surface.

5. Templet and roller means for deploying a plurality of wires and locating said wires in side-by-side spaced-apart relationship, said templet and roller means comprising:

a templet block having a working surface, said roller being movable over said working surface from one end of said block to the other end thereof, a recessed staging surface within said working surface, said staging surface being parallel to said working surface, being between the side edges of said block and being recessed beneath said working surface by a distance which is substantially equal to the diameter of one of said wires, said staging surface having a width which is substantially equal to the combined diameters of all of said wires whereby said wires can be staged in side-by-side co-planar relationship on said staging surface with adjacent wires against each other and with the axes of said wires extending towards said other end of said block, a triangular deploying surface which extends from and is co-planar with said staging surface and which has its apex proximate to said other end of said templet block, a plurality of wire deploying grooves, each of said grooves having an origin at said deploying surface and extending from said deploying surface through said working surface and towards said other end of said block, each of said grooves being dimensioned to receive one of said wires, the two grooves which are outermost and which receive the outside wires of a group of wires on said staging surface having their origins located at a maximum distance from said other end and successive grooves on each side of said deploying surface having their origins located at progressively decreasing distances from said other end whereby, upon positioning said wires in side-by-side parallel relationship on said staging surface with said wires extending towards said other end of said templet block, and upon movement of said roller over said working surface towards said other end, said wires will be successively diverted into said grooves from said deploying surface as said roller moves past said deploying surface and portions of said wires at said other end of said block will then be located in side-by-side spaced-apart relationship.

6. Templet and roller means as set forth in claim 5, said wire-receiving grooves being separated by ribs, first portions of said ribs having top surfaces which are part of, and co-planar with, said working surface, other portions of said ribs which are proximate to said deploying surface being tapered in altitude and width towards said deploying surface, and portions of said ribs which are immediately adjacent to said deploying surface having top edges which slope towards, and merge with, said deploying surface thereby to facilitate diversion of said wires into said grooves during movement of said roller over said working surface and past said deploying surface.

7. Templet and roller means as set forth in claim 5 having a splaying surface extending from said staging surface to said one end of said templet block, said splaying surface extending away from said working surface and being of increasing depth as it extends away from said staging surface whereby, a bundle of said wires can be positioned on said splaying surface and upon movement of said roller over said working surface, said wires will be splayed and located in side-by-side parallel relationship on said staging surface.

8. A method of deploying a plurality of conductors to side-by-side co-planar relationship, with adjacent conductors being spaced-apart by a prescribed distance; the method comprising the steps of:

progressively pressing said conductors into a channel having a depth on the order of one conductor diameter and having a width no greater than the sum of the diameters of all of said conductors so that the outermost conductor located adjacent to one sidewall of said channel is pressed against the adjacent sidewall, further progressively pressing said conductors and pressing said outermost conductor into an outermost groove adjacent to said one sidewall, and initially extending generally parallel to said sidewall, with the next outermost conductor being pressed against said outermost conductor, further progressively pressing said conductors with said second outermost conductor being subsequently pressed into a groove adjacent to said outermost groove, further progressively pressing said conductors so that each next adjacent conductor is subsequently pressed into an adjacent groove, said grooves subsequently diverging to the prescribed distance.

9. A method of deploying a plurality of conductors; initially comprising a multi-conductor cable having a generally circular cross-section and contained within an outer sheath, with the conductors generally lacking relative orientation in said cable; to side-by-side co-planar relationship, with adjacent conductors being spaced-apart by a prescribed distance; the method comprising the steps of:

removing a portion of said outer sheath, progressively pressing said conductors into a channel having a depth on the order of one conductor diameter and having a width no greater than the sum of the diameters of all of said conductors, and having a laterally uninterrupted smooth lower surface so that the outermost conductor located adjacent to one sidewall of said channel is pressed against the adjacent sidewall, further progressively pressing said conductors and pressing said outermost conductor into an outermost groove adjacent to said one sidewall, and initially extending generally parallel to said sidewall, said groove being defined by a portion of said one sidewall and a first ridge emerging from said lower surface with the next outermost conductor being pressed against said outermost conductor, further progressively pressing said conductors with said second outermost conductor being subsequently pressed into a groove adjacent to said outermost groove and defined by said first ridge and a second ridge subsequently emerging from said lower surface, and further progressively pressing said conductors so that each next adjacent conductor is subsequently pressed into an adjacent groove, said grooves subsequently diverging to the prescribed distance.

* * * * *